US006917035B2

(12) United States Patent
Rethwisch et al.

(10) Patent No.: US 6,917,035 B2
(45) Date of Patent: Jul. 12, 2005

(54) COVERING FOR THE APERTURES OF REACTION RECEPTACLES CONSTITUTED IN MICROTITRATION PLATES

(75) Inventors: Hanna Rethwisch, Hamburg (DE); Jorg Richter, Belsch (DE); Boris von Beichmann, Hamburg (DE); Jurgen Lohn, Klein-Meckelsen (DE)

(73) Assignee: Eppendorf AG, Hamburg (DE)

( * ) Notice: Subject to any disclaimer, the term of this patent is extended or adjusted under 35 U.S.C. 154(b) by 301 days.

(21) Appl. No.: 10/355,319

(22) Filed: Jan. 31, 2003

(65) Prior Publication Data

US 2003/0150982 A1 Aug. 14, 2003

(30) Foreign Application Priority Data

Feb. 8, 2002 (DE) ..... 102 05 976

(51) Int. Cl.[7] ..... H01J 5/02
(52) U.S. Cl. ..... 250/239; 250/231.1
(58) Field of Search ..... 250/239, 231.1, 250/216; 210/406, 416.1, 455; 436/178

(56) References Cited

U.S. PATENT DOCUMENTS

| | | | | |
|---|---|---|---|---|
| 3,990,852 | A | 11/1976 | Piazzi et al. | |
| 4,444,310 | A | 4/1984 | Odell | |
| 4,927,604 | A | 5/1990 | Mathus et al. | |
| 6,518,060 | B2 | 2/2003 | Heimberg et al. | |
| 6,666,978 | B2 * | 12/2003 | Steinel | 210/808 |

FOREIGN PATENT DOCUMENTS

| | | |
|---|---|---|
| DE | 298 23 783 U1 | 10/1997 |
| GB | 2 344 420 A | 6/2000 |

OTHER PUBLICATIONS

WO 92/20448, Microplate for Containment of Radioactive Samples, Publication Date: Nov. 26, 1992.
WO 98/08092, Rapid Process for Arrarying and Synthesizing Bead–Based Combinatorial Libraries, Publication Date: Feb. 26, 1998.
WO 99/44742, Sealing Apparatus for Use With Microplates, Publication Date: Sep. 10, 1999.
WO 99/61152, Automation–Compatible Slide Format Sample Cartridge, Publication Date: Dec. 2, 1999.

* cited by examiner

*Primary Examiner*—Que T. Le
(74) *Attorney, Agent, or Firm*—Rankin, Hill, Porter & Clark LLP

(57) ABSTRACT

A covering for apertures of reaction receptacles formed in a microtitration plate, including a hermetic, elastically deforming mat or foil, a frame, and connecting elements. The mat or foil, upon planar deposition on the microtitration plate and following compression, seals the apertures. The connecting elements are fitted onto at least one of the mat or foil and frame and detachably secure the mat or foil to the frame while creating a tension in the mat or foil implementing the connection. The frame (11, 110) is dimensioned so as to permit the frame to be deposited on the microtitration plate (13), such that the mat (12, 120) or foil rests in a planar manner on the microtitration plate, and such that the frame is accessible from above to a pressure and/or heat applying device.

18 Claims, 2 Drawing Sheets

COVERING FOR THE APERTURES OF REACTION RECEPTACLES CONSTITUTED IN MICROTITRATION PLATES

BACKGROUND OF THE INVENTION

1. Field of the Invention

The present invention relates to a covering for microtitration plates that are, in particular, applicable to PCR procedures.

2. Description of Related Art

Depending on their formats, conventional microtitration plates comprise defined numbers of wells that are used as reaction receptacles for receiving liquid specimens.

Microtitration plates are widely used for simultaneously treating different specimens in PCR procedures. In the course of PCR, the microtitration plate is inserted into a thermo-cycler wherein it is repeatedly heated and cooled. As a result, evaporation and condensation take place in the reaction receptacles. In order to avoid loss of liquid and any cross-contamination, the apertures of the reaction receptacles must be hermetically sealed during PCR.

It is known in this respect to mount flexible rubber mats on the microtitration plates. Sealing is implemented by applying pressure from above, for instance by means of a height-adjustable lid affixed to the cycler. Thereupon, the rubber mat under pressure will seal the reaction receptacle apertures. This design incurs the drawback that such flexible rubber mats are not easily handled in automated workstations.

The European patent document 1,142,795 describes sealing using a sealing mat fitted with a soft lower layer affixed to a rigid support plate. On account of the rigid feature of the support plate, such a covering may be handled in workstations. On the other hand the stratified feature of this covering is comparatively expensive.

SUMMARY OF THE INVENTION

The present invention is directed toward a covering that may be handled in an automated manner by conventional robots and that may be manufactured at lower cost than the coverings of the state of the art.

As in the state of the art, the function of the present invention is to cover the microtitration plate with an elastically deforming mat or foil. Illustratively the mat may consist of rubber, silicone or TPE and preferably has a thickness of between 0.5 mm and 2 mm. Obviously, other materials or thicknesses also apply. Basically, the function of the present invention shall be met by all mats that, upon being placed in planar manner on, and then compressed against, a microtitration plate shall seal the apertures in this plate. Illustratively, appropriate mats exhibit a Shore hardness preferably >40.

A foil of the invention for instance may be made of polycarbonate or polyester. Especially appropriate mats or foils are fitted with elastically deforming projections at their side away from the microtitration plate. Using such mats, height differentials on the microtitration plate may be compensated for in an especially simple manner.

Preferably, the projections are made of the same material as the mat or foil and exhibit approximately the same height. In especially preferred manner, the projections assume the shape of button-like bosses.

Preferably, the number and position of the button-like bosses on the mat or foil are selected independently of the positions and number of the microtitration plate's apertures, whereby the advantage is attained that mats or foil of this design may be used with different microtitration plates. The number and positions of the bosses merely need be selected in such a way as to enable as uniform as possible a compression of the lower side of the elastic mat or foil across the entire zone of sealing. In an especially preferred manner, there shall be unambiguously more bosses or protrusions than there are apertures.

In the invention, moreover, the mat or foil used to cover the microtitration plates shall be held in planar manner in a substantially rigid frame. The dimensions of the frame and the configuration of the mat or foil in the frame are selected so as to allow depositing of the frame on the microtitration plate in a manner that the mat or foil shall rest in a planar manner on the microtitration plate's side fitted with the apertures.

In its mounted state, moreover, the frame shall not encumber an adequate cross-section of the microtitration plate covered by the mat or foil in such manner that a pressure may be applied by means a suitable device directly to the top side of the mat or foil.

Basically, the term "frame" includes all rigid supports receiving a mat or foil tensioned therein. A conceivable design, for instance, is a closed, rectangular frame with two end sides and two lateral sides connecting the end sides. However, an open, for instance, U-shaped frame also is applicable, wherein the two legs are connected only by one element. Obviously, other geometries also are applicable. An appropriate frame only need meet the above criteria.

The frames of the invention may be made of different materials, in particular of plastics such as polypropylene or polycarbonates or the like, but also of metal and other materials.

In one essential feature of the present invention, the frame includes connecting elements allowing to detachably connect the mat or foil to the frame to secure by tension the mat or foil connection.

The connecting elements of the invention implement self-locking connection of the mat or foil to the frame by making use of its elasticity. Assuming a rectangular frame and mat formats matching the size of the microtitration plate to be covered, then in the simplest case two connecting elements affixed to two mutually opposite sides of the frame would suffice, each of them, for instance, engaging the frame underneath. The connection would be implemented by the mat being connected on one side to the frame, elastically stretched, and affixed under tension to the other connecting element at the other frame side. Such a connection is implemented and released in very simple manner. It is wholly adequate in typical workstations because relative motions that might undo the connection of the invention do not arise between the frame and the mat.

The main advantage of the present invention is that the frame and the mat or foil can be connected to each other in a simple manner and are just as easily disassembled. As a result, separate purification or sterilization of both components is very easily carried out.

Illustratively, a mat used in the covering of the invention can be re-used in a problem-free manner more than 20 times. If expertly handled, the frames may be re-used even more often.

The present invention offers the further advantage that its covering may be used in automated processes, the user merely needing two frames for workstation operation, the two frames then accepting alternatingly sterilized-or new mats or foils.

As mentioned above, the mat or foil in particular shall be fitted with connecting elements able to grip the frame at its rear side. Obviously as well, the frame may be matched in the zone of connection to the mat's or foil's connecting elements or be fitted with their own. Illustratively, the mat or foil may be fitted at its corners with perpendicularly projecting pins that may be inserted into corresponding frame recesses. Obviously too, the mat or foil may only comprise holes, for instance, in its corner zones that shall be pulled over corresponding frame pins or protrusions.

A preferred embodiment of the present invention comprises connecting elements in the form of angled channel or shape segments at the mat or foil that are lockable onto the frame corners. Such connecting elements make possible an especially reliable self-locking connection.

The above-described connections are merely illustrative. The invention covers all designs wherein the mat or foil is connected to the frame under elastic deformation, the connection being secured or kept in place by the mat tension so produced.

Contrary to the case of the foils known in the state of the art, the covering of the present invention allows handling by the robots available in a typical workstation. The robots are well able to properly seize and displace a rigid frame in a defined manner, unlike the case of a bare foil.

Robots in conventional work stations are essentially charged with the task of moving microtitration plates from one position into another position, for instance from a processing position to a cycler. The displacement of the frame of the invention, of which the outside dimensions of a preferred embodiment may only be slightly larger than those of a microtitration plate, raises no problem.

Accordingly, the PCR covering of the invention may be deposited in conventional workstations, for instance from a stock position onto a microtitration plate situated in a cycler, and then may be compressed by a heating lid contained in the cycler.

Such an application illustratively is Online-PCR. In this application, but also in others, optical control from above of the reaction receptacles, however, is required.

Accordingly, in another embodiment of the present invention, the coverings shall be in the form of optically transparent foils. In particular, as regards Online-PCR applications, advantageously the foils shall be transparent to the wavelengths required for measurement and excitation.

Another design relates to the application wherein liquid specimens are removed from the reaction receptacles without thereby removing the foil or mat. In this design, the mat or foil assumes a geometry allowing the simplest possible piercing of pipettes or other specimen withdrawal elements.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
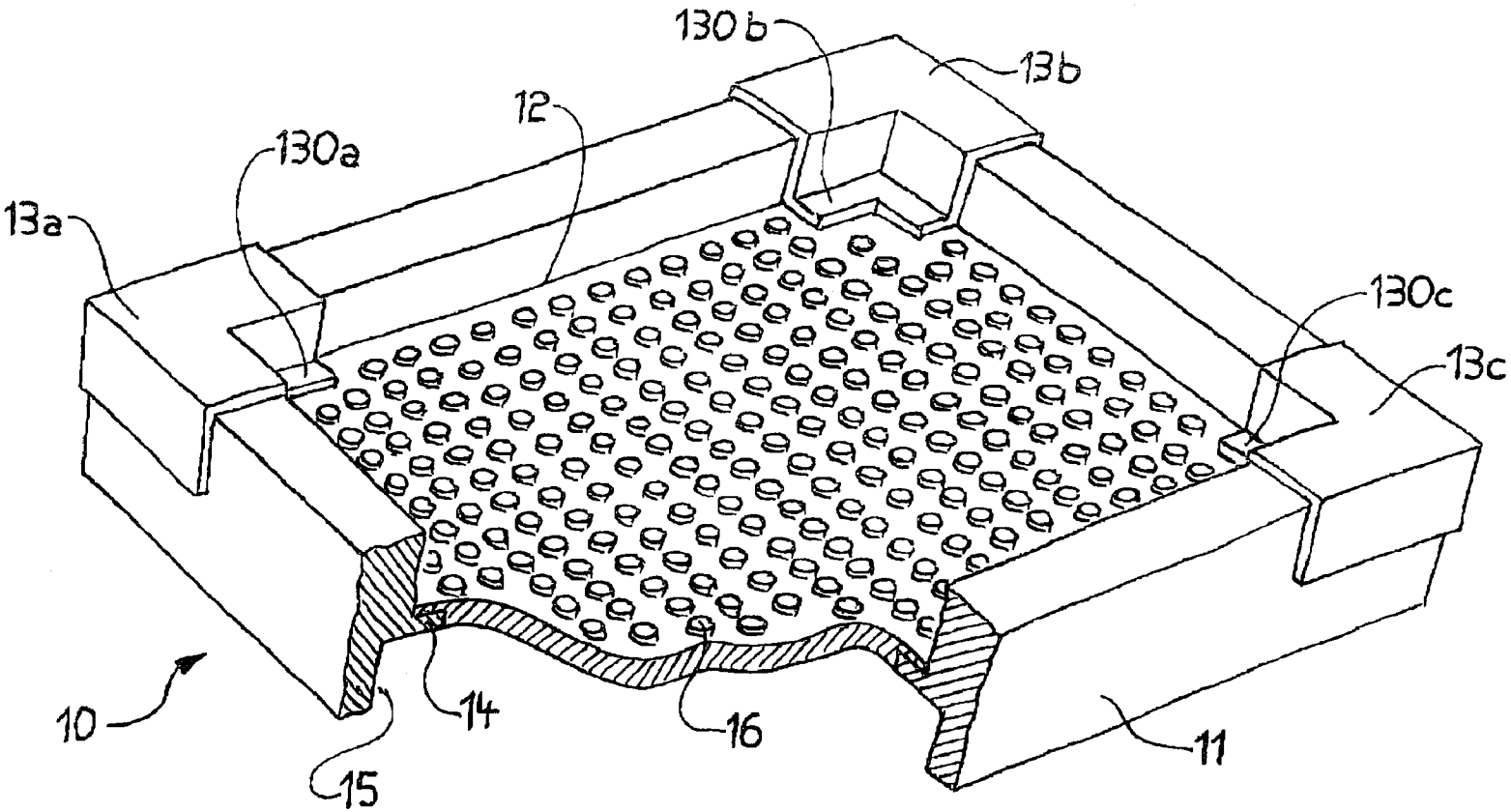
FIG. 1 is a partial perspective of an illustrative embodiment of the PCR covering of the invention.

FIG. 1 shows an illustrative embodiment of the covering 10 of the invention fitted with a rectangular frame 11. Illustratively a mat 12 is held in tensioned manner inside the frame 12. Obviously, a foil might also be used instead of a mat.

Angled channel or shaped segment connecting elements 13*a–c* are affixed to the mat 12 and serve as connection elements for connection to the frame 11. The angled channel or shaped segment connecting elements 13*a–c* each may be plugged onto the particular corners of the frame 11. The size of the mat 11 is less than the frame size and requires stretching to be connected to the frame 11. The mat tension so generated secures the shown implemented connection.

The mat 12 can be affixed, for instance, by bonding or in another manner to the angled channel or shaped segment connecting elements 13*a–c* at protrusions 130*a–c* of the connecting elements.

The dimensions of the frame 11 are selected such that the mat 12 is freely accessible from above, for instance, to a device driving a compression plunger. Also, a peripheral projection 14 is fitted on the frame 11 and supports the mat 12 at its edges.

Moreover, the frame dimensions preferably correspond by their ratio basically to those of a microtitration plate. Such a frame is moved in an especially simple manner by a robot available in conventional workstations. The frame contour is required to be only slightly larger than, while otherwise corresponding to that of, a microtitration plate, substantially the same displacements and coordinates as already were selected when depositing the microtitration plate into the specified position also may be selected for depositing the covering on this microtitration plate. In this respect, a peripheral clearance 15 in the frame 11 shall preferably be provided by means of which the frame may be aligned with an omitted microtitration plate.

Figure 2:
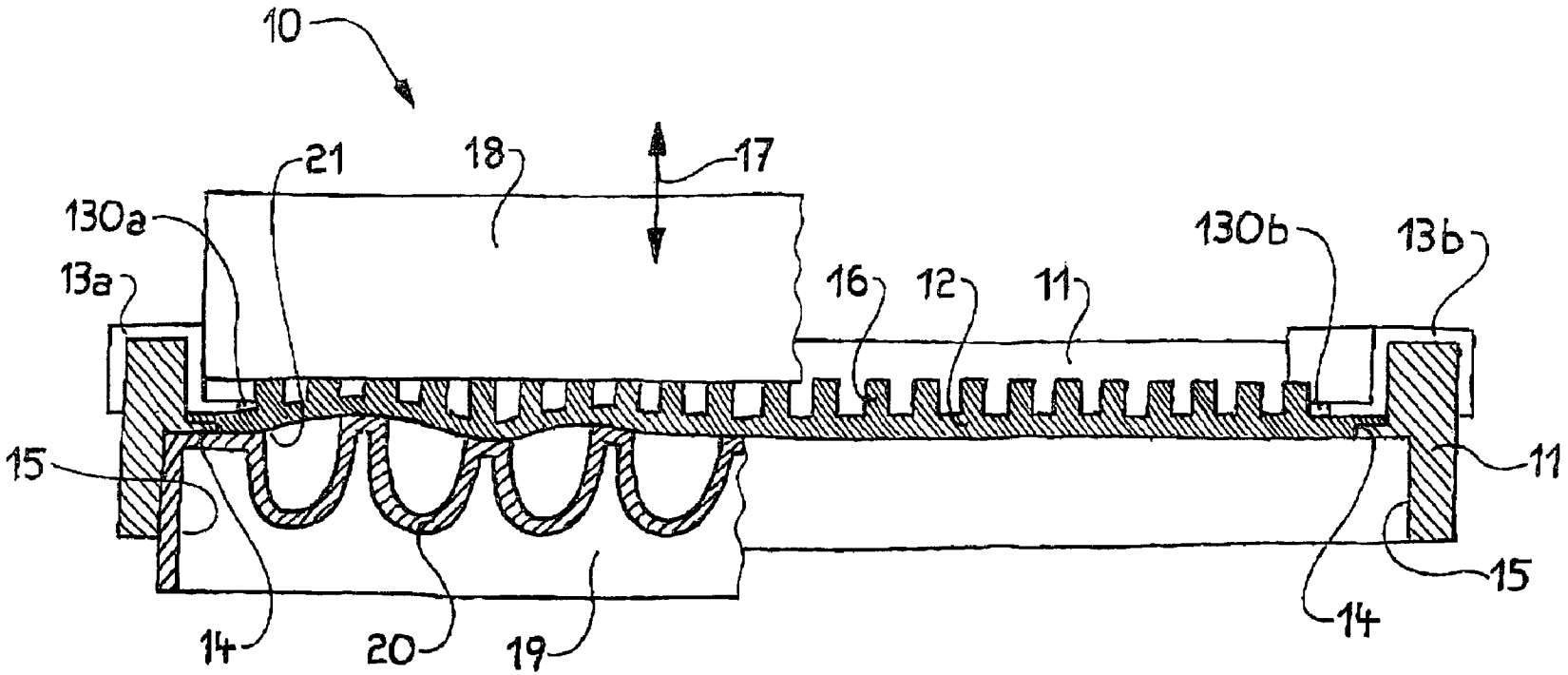
FIG. 2 shows an embodiment of the PCR covering of the invention of FIG. 1 when deposited on the microtitration plate.

Furthermore, at its upper side away from the microtitration plate to be covered, the mat 12 is fitted with protrusions 16 in the form of button-like bosses that, as shown in FIG. 2, assure especially good compression of the mat 12 against the microtitration plate.

This feature is made clear in FIG. 2, which shows a sectional elevation of the covering 10 of FIG. 1 deposited on a microtitration plate 19. The microtitration plate 19 is fitted with reaction receptacles 20 having apertures 21 that are configured not in one plane, but rather at different heights, which are entailed, for instance, by manufacturing tolerances regarding the microtitration plate. The button-like bosses 16 on the mat 12 are used to compensate for such tolerances.

In general, the mat 12 is compressed by means of a planar compression element 18 displaceable in the direction of the arrow 17 against the microtitration plate 19. The compression element may be, for instance, a vertically displaceable cycler lid or a vertically displaceable element configured in a cycler lid.

It follows that after making contact with the bosses 16, the compression element 18 will compress them to varying degrees as a function of the surface topography of the microtitration plate 19 and, as a result, will assure optimal pressure on the mat 12.

FIG. 2 also shows the connecting elements 13*a* and 13*b* gripping the frame 11 at its corners and thereby enabling self-locking connection between the mat 12 and the frame 11.

FIG. 2 is a cross-sectional view of the covering 10 of FIG. 1 deposited on a microtitration plate 16. The microtitration plate 16 is fitted with reaction receptacles 17 comprising apertures 18. The covering 10 is deposited such that the mat 12 covers the apertures 18 of the reaction receptacles 17.

FIG. 2 again shows the connecting elements 13*a* and 13*b* enclosing the frame 11 in the zone of its corners and thereby implementing self-locking connection between the mat 12 and the frame 11.

What is claimed is:

1. A covering for apertures of reaction receptacles constituted in a microtitration plate, comprising a hermetic, elastically deforming mat or foil which, upon planar deposition on the microtitration plate and following compression, seals the apertures, further comprising a frame and connecting elements that are fitted onto at least one of the mat or foil and frame and that allow the mat or foil to be detachably secured to the frame while creating a tension in the mat or foil implementing said connection, the dimensions of the frame being selected so as to permit the frame to be deposited on the microtitration plate, such that the mat or foil rests in a planar manner on the microtitration plate, and wherein the frame is accessible from above to a device applying pressure and/or heat.

2. The covering as claimed in claim 1, wherein the frame and the mat or foil are rectangular.

3. The covering as claimed in claim 1, wherein the mat or foil is fitted with connecting elements and the frame's shape in a zone of connection matches a shape of the connecting elements.

4. The covering as claimed in claim 3, wherein the mat or foil is fitted with connecting elements designed to seize a rear of the frame.

5. The covering as claimed in claim 3, wherein connecting elements are configured in the corner zones of the mat or foil.

6. The covering as claimed in claim 5, wherein the connecting elements are angled channel or shaped segments that are adapted to engage the frame corners.

7. The covering as claimed in claim 1, further comprises an optically transparent foil.

8. The covering as claimed in claim 1, wherein the mat is made of rubber, silicone or TPE.

9. The covering as claimed in claim 1, wherein a thickness of the mat is between 0.5 mm and 2 mm.

10. The covering as claimed in claim 1, wherein the foil is made of polycarbonate or polyester.

11. The covering as claimed in claim 1, wherein the mat or foil is re-usable.

12. The covering as claimed in claim 1, wherein a side of the mat or foil away from the microtitration plate includes elastically deforming protrusions.

13. The covering as claimed in claim 12, wherein the protrusions and the mat or foil are made from one type of material.

14. The covering as claimed in claim 12, wherein the protrusions have a generally equal height.

15. The covering as claimed in claim 12, wherein an array of the protrusions is independent of a position of the apertures to be sealed in the microtitration plate.

16. The covering as claimed in claim 12, wherein a number of protrusions is higher than a number of apertures to be sealed in the microtitration plate.

17. The covering as claimed in claim 12, wherein the protrusions are shaped as button-like bosses.

18. The covering as claimed in claim 1, wherein the mat or foil is fitted with connecting elements and the frame has connecting elements that may be made to engage the mat or foil connecting elements.

* * * * *